United States Patent [19]

Sewell et al.

[11] Patent Number: 4,955,557

[45] Date of Patent: Sep. 11, 1990

[54] HANDCRAFT YARN DISPENSER

[76] Inventors: Virgil L. Sewell; Martha A. Sewell, both of 1150 N. Canterbury Ct., Dallas, Tex. 75208

[21] Appl. No.: 477,570

[22] Filed: Feb. 9, 1990

[51] Int. Cl.[5] ..... B65H 49/30; B65H 49/32

[52] U.S. Cl. ..... 242/134; 242/139; 242/141

[58] Field of Search ..... 242/134, 139, 141, 129.5, 242/129.6, 129.7, 130, 130.4, 55.54

[56] References Cited

U.S. PATENT DOCUMENTS

| | | | |
|---|---|---|---|
| 207,105 | 8/1878 | Catlin | 242/139 |
| 2,491,585 | 12/1949 | Sammons | 242/141 |
| 2,551,070 | 5/1951 | Taylor | 242/139 |
| 2,702,675 | 2/1955 | Leaver | 242/130.4 |
| 4,059,243 | 11/1977 | Hartley | 242/129.6 |
| 4,112,711 | 9/1978 | Tripp | 242/141 X |
| 4,456,197 | 6/1984 | Canetta | 242/130.4 |
| 4,634,077 | 1/1987 | Wilson | 242/139 |
| 4,792,102 | 12/1988 | Olson | 242/55.54 |

FOREIGN PATENT DOCUMENTS

| | | | |
|---|---|---|---|
| 11484 | 2/1933 | Australia | 242/141 |

*Primary Examiner*—Stanley N. Gilreath
*Attorney, Agent, or Firm*—V. Lawrence Sewell

[57] ABSTRACT

A device permitting yarn or the like to be pulled from a skein by the performance of a handcraft such as knitting. A spindle passes through the skein and a support structure holds the spindle in a vertical position. The support structure includes a base, an upright attached to the base, and a spindle support at the top of the upright. The base and spindle support have means rotatably attaching them to the upright to allow folding up the device for storage and portability. However, means are provided to fix the position of the upright with respect to the base, when the device is in use. The ends of the spindle fit into recesses in the base and spindle support. The means for attaching the spindle support to the upright allows the spindle support to rotate upward so that the spindle can be inserted in and removed from the recesses. The spindle has a spacer attached near its lower end to hold the yarn away from the base. In a preferred embodiment, the recesses into which the yarn spindle fits are provided with bearing surfaces to reduce rotational friction.

4 Claims, 1 Drawing Sheet

HANDCRAFT YARN DISPENSER

BACKGROUND OF THE INVENTION

This invention relates to a handcraft device for permitting yarn, thread and the like to be used from a skein conveniently.

In certain handcraft activities, such as knitting, yarn or thread is purchased in a wound bundle or skein, normally without a spool. Accordingly, one of the traditional parts of a knitting project is to stop frequently and unwind some yarn from the skein before continuing with the knitting itself.

The problem of making the unwinding of the yarn more manageable has been approached previously by Kenneth H. Hartley, as described in U.S. Pat. No. 4,059,243. He has described a device in which the yarn has a rod inserted through it and the rod is mounted horizontally in a holder. The skein can rotate in the device, permitting yarn to be pulled out in an orderly manner.

The present invention provides an additional level of convenience to that of the Hartley patent. It is a principle advantage of the present invention that very little force is required to pull the yarn from the skein. As a result, generally yarn is dispensed from the skein simply by an act such as knitting and no time needs to be given to the traditional activity of unwinding the yarn.

SUMMARY OF THE INVENTION

In accordance with the present invention, there is provided a spindle to pass through the skein and a support structure that holds the spindle in a substantially vertical position. The support structure includes a base, an upright attached to the base, and a spindle support at the top of the upright. The base and spindle support have means rotatably attaching them to the upright to allow folding up the device of the invention for storage and portability. However, means are provided to fix the position of the upright with respect to the base, when the device is in use. The ends of the spindle fit into recesses in the base and spindle support. The means for attaching the spindle support to the upright allows the spindle support to rotate upward so that the spindle can be inserted in and removed from the recesses. The spindle has a spacer attached near its lower end to hold the yarn away from the base.

In a preferred embodiment, the recesses into which the yarn spindle fits are provided with bearing surfaces to reduce rotational friction. Further, the upper end of the spindle is reduced in diameter, also reducing rotational friction.

In addition to the very low force required to dispense the yarn, it is also an advantage of the invention that yarn may be dispensed from the device of the invention over a wide range of angles in the horizontal plane. ,

DESCRIPTION OF THE PREFERRED EMBODIMENT

Figure 1:
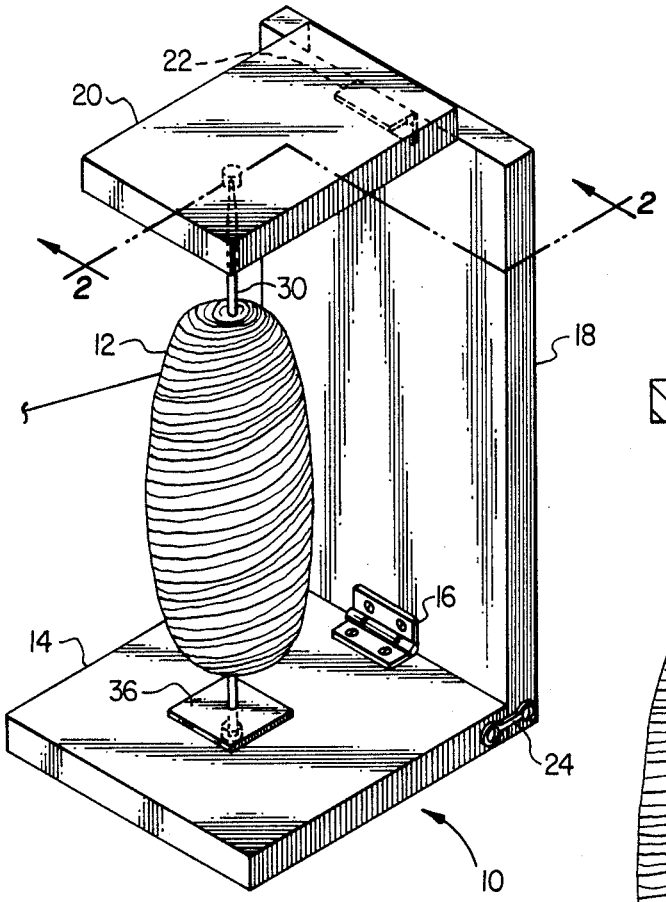
FIG. 1 is a perspective view of a device for dispensing yarn in accordance with the invention.
Figure 2:
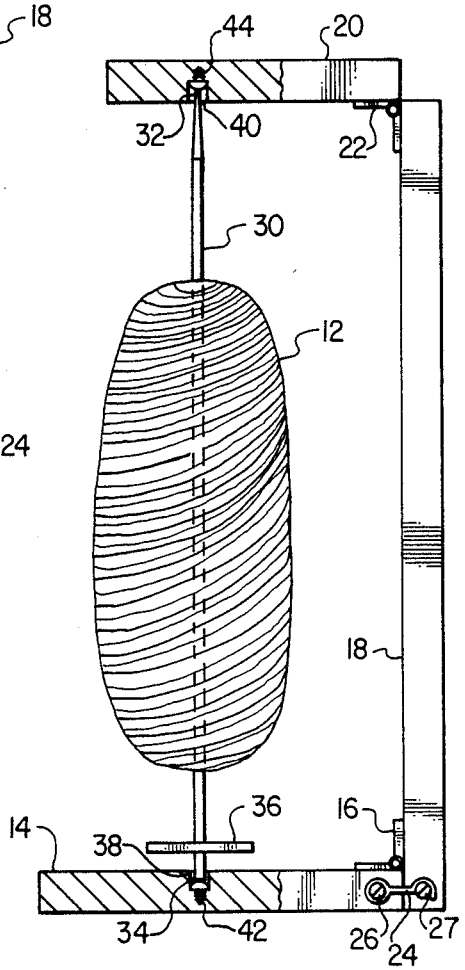
FIG. 2 is an elevation view of the device shown in FIG. 1, partially sectioned along the section line shown in FIG. 1.

In FIGS. 1 and 2, the dispensing device according to the invention, indicated generally by the reference numeral 10 is shown with a skein 12 of yarn, thread or the like to be dispensed by knitting or a similar activity.

Device 10 has a base 14 attached by hinge 16 to an upright 18. A spindle support 20 is attached to upright 18 by a hinge 22. In a preferred embodiment, the base 14, upright 18 and spindle support 20 are fabricated from boards ¾" thick. A latch 24 connects base 14 and upright 18 to fix the position of the upright with respect to the base. Latch 24 can be connected to base 10 by a screw 26 and can latch against a screw 27 in upright 18 to connect to the upright. Preferably, another latch, not shown, is similarly mounted at the opposite edges of base 10 and upright 18 to provide an additional connection between them.

Spindle 30 is of a sufficiently slender diameter to conveniently pass through skein 12. One end 32 of spindle 30 is tapered to a reduced diameter to facilitate penetration of the skein and reduce turning friction at that end 32. Near the other end 34 of spindle 30, is a spacer 36 mounted in fixed relation to the spindle 30. Spacer 36 must be mounted so that it is spaced from base 14 to keep the skein 12 from dragging against base 14 during dispensing.

Base 14 includes a recess 38. Spindle support 20 has a recess 40. As can be particularly seen in FIG. 2, recesses 38 and 40 hold the ends of spindle 30. In a preferred embodiment, recess 38 has a screw 42 mounted into the bottom of the recess, so that the head of the screw provides a bearing surface against which spindle 30 can turn with low friction. Similarly, recess 40 has a screw 44 that provides a bearing surface for end 32 of spindle 30.

It will be noted that spindle support 20 is shown in FIG. 1 to be smaller than base 14. While base 14 must be large enough to serve as a stable base for the device 10, spindle support 20 need only provide a secure support for end 32 of spindle 30. In this regard, spindle support 20 must have enough weight that the slight pull on the yarn of skein 12 during knitting will not dislodge spindle end 32 from recess 40. Spindle support 20 is preferably made smaller and lighter than base 14, in order to reduce friction exerted by support 20 on the end 32 of spindle 30.

In operation, knitting or a similar activity pulls yarn or thread from skein 12 causing it to turn. The vertical orientation of the spindle results in a turning friction of spindle 30 against base 14 and spindle support 20 that results mainly from the tips of the spindle turning against the bearing surface provided by screws 42 and 44. This friction can be made very small, particularly with the use of the bearing surfaces provided by screws 42 and 44. Skein 12 is kept from creating a friction drag on base 14 by spacer 36.

The operation of device 10 contrasts with that of a yarn dispenser designed to operate with the spindle and skein in a horizontal arrangement. We believe that the vertical orientation of the spindle according to the present invention has allowed a considerable reduction of frictional forces, compared to a horizontal arrangement such as that in the referenced patent of Hartley. In addition, the skein 12 will generally have irregularities that cause the material on one side of a spindle to be heavier than that on the other side. In a horizontal mounting of the spindle and skein, this causes one portion of the skein to hang down and provide a weight moment arm that must be overcome when pulling on the yarn to dispense it. In the vertical arrangement provided by device 10, this weight moment arm is not a factor.

The device 10 of the invention has another advantage compared to one in which the spindle and skein are mounted horizontally. In the horizontal arrangement, it is best to pull the yarn from the skein approximately perpendicular to the spindle (when projected on the horizontal plane). In the device 10 of the invention, the person using the yarn is free to move about and dispense the yarn from the skein over a wide range of angles in the horizontal plant, without affecting the operation of the device 10.

To disassemble device 10 for storage or transportation, spindle support 20 is rotated upward in a vertical plane around hinge 22, freeing end 32 of spindle 30 from recess 40. This in turn allows end 34 of spindle 30 to be lifted from recess 38. When latch 24 and any corresponding latch (not shown) on the opposite edges of base 14 and upright 18 are unlatched, base 14 may be folded about hinge 16 to lie against upright 18 and spindle support 20 may be rotated about hinge 22 to lie against upright 18.

Figure 3:
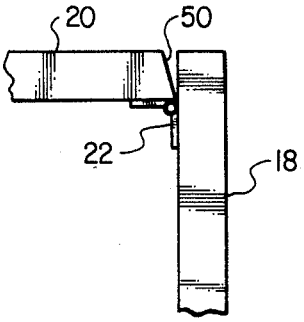
FIG. 3 is a partial elevation view of an alternative embodiment of the invention.

We have also conceived that other means may be provided to allow the upward rotation of spindle support 20 that permits insertion into and removal of the spindle from recesses 38 and 40. As shown in FIG. 3, if spindle support 20 is attached to upright 18 so as to abut it, then a bevel 50 can be provided on one end of spindle support 20 to permit the support to rotate upward enough so that spindle 30 can be inserted and removed.

While the invention has been described in terms of a preferred embodiment, it will be apparent to those skilled in the art that various modifications may be made, while continuing to derive the benefits of our invention, and without departing from the scope of the invention as claimed below.

We claim:

1. A handcraft device for dispensing yarn, thread and the like from a skein, comprising:

a base having a recess therein to be positioned opening upward;

an upright, attached to one side of the base, to be positioned extending vertically, upwards of the base;

means for fixing the position of the upright with respect to the base;

a spindle support having a recess therein to be positioned opening downward;

a spindle sufficiently slender to pass through the skein;

means for attaching the spindle support at one side thereof to the upright near the top thereof and for providing rotation of the spindle support in a vertical plane to a position wherein the spindle support recess is above the base recess so that the spindle can be mounted with one end thereof in the spindle support recess and the other end thereof in the base recess, said provided rotation including rotation of the spindle support upwards from said one end of the spindle sufficiently to allow the spindle to be inserted and removed from said recesses; and a spacer means attached to the spindle near said other end thereof for spacing the skein from the base.

2. The device of claim 1, wherein each of said recesses contains a bearing surface mounted therein to contact the ends of said spindle.

3. The device of claim 1, wherein said means for fixing the position of the upright with respect to said base includes a latch for rigidly interconnecting the upright and the base.

4. A handcraft device for dispensing yarn, thread and the like from a skein comprising:

a base having a recess therein to be positioned opening upward, the recess containing a metal bearing surface;

an upright, hingedly attached to one side of the base to be positioned extending vertically, upwards of the base;

latch means for interconnecting the base and upright so as to fix the relative positions thereof;

a spindle support having a recess therein to be positioned opening downward, the latter recess containing a metal bearing surface;

a spindle, having a sufficiently slender diameter to pass through the skein, and having at least one end thereof reduced to a smaller diameter;

hinge means for attaching the spindle support at one side thereof to the upright near the top thereof and for providing rotation of the spindle support in a vertical plane to a position in which the spindle support recess is above the base recess so that the spindle can be mounted with said one end thereof against the bearing surface in the spindle support recess and the other end thereof against the bearing surface in the base recess, said spindle support and upright being attached by the hinge means so that said provided rotation includes rotation of the spindle support upwards from said one end of the spindle sufficiently to allow the spindle to be inserted and removed from said recesses; and a spacer means fixedly attached to the spindle near said other end thereof for spacing the skein from the base.

* * * * *